US005482246A

United States Patent [19]

Derkoski

[11] Patent Number: 5,482,246

[45] Date of Patent: Jan. 9, 1996

[54] ANCHORING DEVICE HAVING AN AUGER AND A SPIRAL-SHAPED MEMBER MOUNTED TO A DISTAL END OF THE ANCHORING DEVICE

[75] Inventor: Barbara Derkoski, Tuckerton, N.J.

[73] Assignee: Sandgrabbers, Inc., Little Egg Harbor, N.J.

[21] Appl. No.: 262,012

[22] Filed: Jun. 17, 1994

[51] Int. Cl.[6] ..... F16M 13/00

[52] U.S. Cl. ..... 248/530; 248/156

[58] Field of Search ..... 248/530, 532, 248/533, 156, 112, 87, 509; 52/157, 165; 135/16, 98

[56] References Cited

U.S. PATENT DOCUMENTS

| | | | |
|---|---|---|---|
| 495,471 | 4/1893 | Brown | 52/157 |
| 906,438 | 12/1908 | Lemerand | 52/157 |
| 3,710,523 | 1/1973 | Taylor | 52/157 |
| 5,046,699 | 9/1991 | Perreault et al. | 248/533 |
| 5,098,057 | 3/1992 | Gran et al. | 248/530 |
| 5,122,014 | 6/1992 | Genfan | 248/156 X |
| 5,152,495 | 10/1992 | Jacinto et al. | 248/545 |
| 5,230,187 | 7/1993 | Reimann | 52/102 |
| 5,358,209 | 10/1994 | Ward | 248/545 |

FOREIGN PATENT DOCUMENTS

| | | | |
|---|---|---|---|
| 18796 | 2/1972 | Australia | 52/157 |

*Primary Examiner*—J. Franklin Foss
*Attorney, Agent, or Firm*—Charles I. Brodsky

[57] ABSTRACT

An anchoring device having an auger disposed circumferentially around the device and a spiral-shaped member mounted to a distal end of the device to facilitate insertion of the device into sand or loose dirt. The auger preferably includes a radially outward edge which is upwardly curved to give the auger a generally scoop-shaped configuration. This scoop-shaped configuration is capable of entering the ground and retaining earthen materials and thereby provides a significant anchoring effect. The anchoring device is either attachable to the bottom end of a device to be anchored, such as an umbrella post, or is integrally formed therewith.

11 Claims, 3 Drawing Sheets

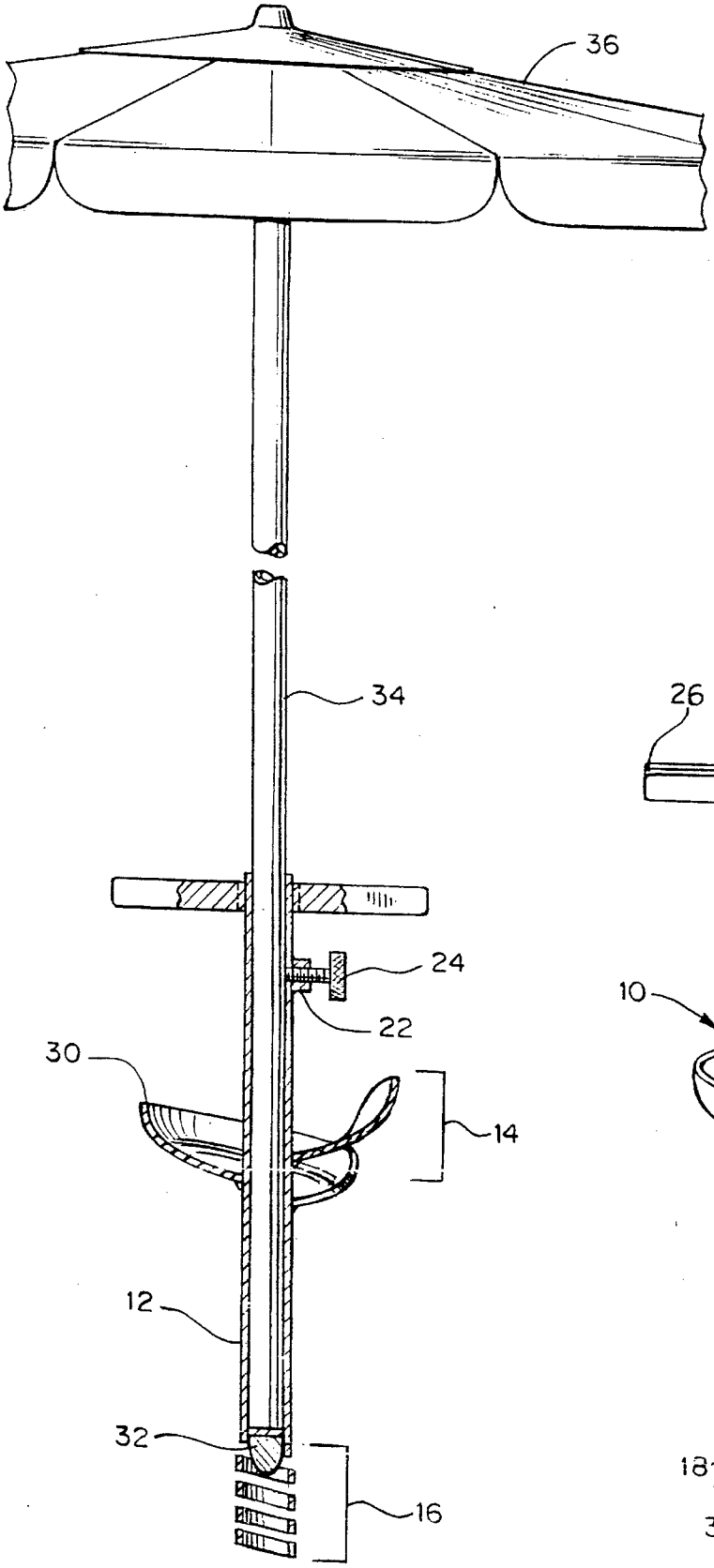
FIG. 2
FIG. 1
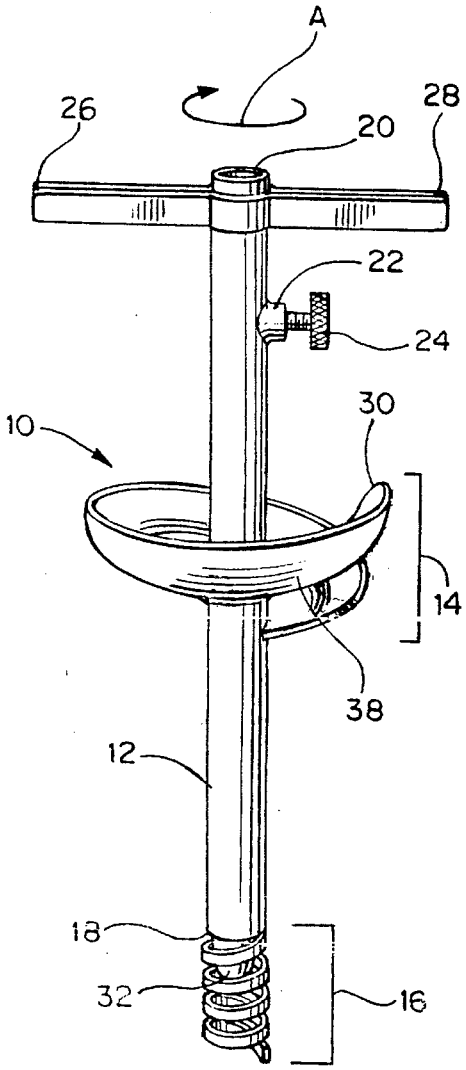

ANCHORING DEVICE HAVING AN AUGER AND A SPIRAL-SHAPED MEMBER MOUNTED TO A DISTAL END OF THE ANCHORING DEVICE

BACKGROUND OF THE INVENTION

The present invention relates to an anchoring device for anchoring a post or pole into the ground, particularly an anchoring device suited for anchoring a beach umbrella into the ground or sand and having an auger disposed circumferentially around the device and a spiral-shaped member mounted to the distal end of the device.

There have been several attempts at anchoring umbrellas into the ground in a secure manner. U.S. Pat. No. 5,046,699 to Perreault et al., for example, discloses an anchoring device for an umbrella post. The anchoring device includes a screw member attached to a lower end of the umbrella post, which screw member can be rotationally driven into the ground for the purpose of securing the umbrella in place. Similar devices are disclosed in U.S. Pat. Nos. 5,156,369 to Tizzoni and 4,850,564 to Paden.

In addition, U.S. Pat. No. 818,061 to Toy, Jr. et al. discloses an auger-like land anchor comprising a helical, upwardly angled disk which is perhaps best illustrated in FIG. 2 of the Toy patent.

U.S. Pat. No. 4,688,969 to Bruser et al. discloses an electrical ground rod installation device comprising an auger mounted to the distal end of an elongated drive shaft. With reference to FIG. 2 of the Bruser patent, the auger is defined by an upwardly angled, helical screw 42.

U.S. Pat. No. 4,858,876 to Moreno discloses a post and ground support utilizing a helical member which, in turn, defines an auger for digging the ground support into the earth. U.S. Pat. Nos. 2,234,907 to Williams and 571,624 to Ryan each disclose a screw anchor. U.S. Pat. No. 5,135,192 to Winkler discloses a ground anchor comprising a flat plate and a helical rod extending at a right angle from one surface of the plate.

Although the foregoing devices may be generally effective in securing an umbrella post into dirt, or into sand on calm days, they typically provide less than adequate results on windy days. Specifically, the foregoing prior art devices are easily ripped out of sand or loose dirt if an umbrella secured thereby is subjected to windy conditions. This, in turn, results in a great deal of inconvenience to anyone relying on the umbrella for shade, and may present a safety risk on crowded beaches where a blowing umbrella could injure an unsuspecting beach-goer.

SUMMARY OF THE INVENTION

It is a primary object of the present invention to overcome the shortcomings of the prior art by providing an anchoring device capable of securely anchoring an object to the ground, regardless of whether the ground is made up of sand or loose dirt, and regardless of whether the object is subjected to windy conditions.

Another object of the present invention is to provide an anchoring device which can be quickly secured to sand or loose dirt without exerting a significant amount of effort.

These and other objects of the present invention are achieved by providing an anchoring device having an auger circumferentially disposed around the device and a spiral-shaped member mounted to the distal end of the device. The auger preferably includes a radially outward edge which is upwardly curved to give the auger a generally scoop-shaped configuration. This scoop-shaped configuration is capable of retaining sand and other earthen materials and thereby provides a significant anchoring effect. The anchoring device can be either attached to the bottom end of an umbrella post, or can be integrally formed therewith.

The above and other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of an anchoring device according to a preferred embodiment of the present invention.

FIG. 2 is a cross section of the anchoring device of FIG. 1 illustrating its ability to receive the post of a beach umbrella.

DETAILED DESCRIPTION OF THE PREFERRED EMBODIMENTS

Figure 4:
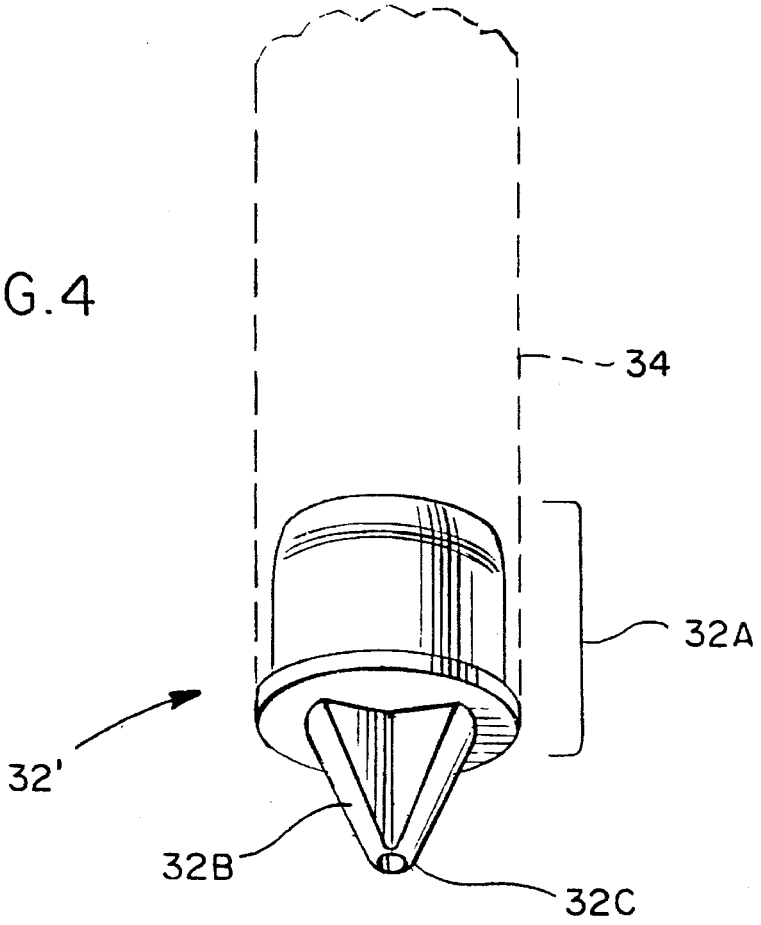
FIG. 4 is a perspective view of a tip located at a distal end of the anchoring device according to the present invention.

The preferred embodiments of the present invention will now be described with reference to FIGS. 1–5.

FIG. 1 illustrates an anchoring device 10 comprising a shaft 12, an auger 14 and a spiral-shaped member 16. The shaft 12 includes a lower longitudinal end 18 and an upper longitudinal end 20. The shaft 12 is preferably constructed from a hollow steel tubing which, in turn, has a wall thickness of approximately 0.035 inches and has a seam (not shown) extending longitudinally along the length of the shaft 12. Preferably, the spiral-shaped member 16 and the auger 14 are welded to the shaft 12.

In the preferred form, the shaft 12 also includes a threaded nut 22 securely mounted to the shaft 12 and a hole defined through the shaft 12 at a position corresponding to that of the threaded nut 22. The threaded nut 22 is preferably secured to the shaft by welding the nut 22 to the outside of the shaft 12. The threaded nut is preferably 0.5 inches high and 0.75 inches wide and is made of steel. A thumb screw 24 is threadedly received in threaded nut 22 and the hole in the shaft 12.

A pair of handles 26,28 project radially out from the shaft 12 to facilitate rotation of the anchoring device 10 about a longitudinal axis thereof. The handles 26,28 can be conveniently manufactured by first forming an elongated ring of steel and then placing the ring concentrically around the second longitudinal end 20 of the shaft 12. The ring is then deformed to snugly encircle the shaft 12. After deformation, the ring and the handles 26,28 defined thereby, are rigidly welded to the second longitudinal end 20.

The auger 14 is disposed circumferentially around the shaft 12 and is welded thereto. The auger preferably comprises one complete turn about the longitudinal axis of the shaft 12. The auger 14 also includes a radially outward edge 30 which is upwardly curved to give the auger a scoop-shaped configuration. This scoop-shaped configuration tends to retain earthen materials and thereby provides a significant anchoring effect.

Preferably, the auger 14 further comprises a curved bottom edge which facilitates penetration of the auger 14 into the ground, and a rounded upper edge to prevent injury from an otherwise abrupt edge.

The spiral-shaped member 16 is connected to, and extends beyond, the first longitudinal end 18 of the shaft 12. Preferably, the spiral-shaped member is manufactured from a 0.25 inch diameter steel rod and is configured so that the spiral form has an outer diameter which is greater than the outer diameter of the shaft 12.

The anchoring device 10 further preferably includes a projection 32 at the first longitudinal end 18 of the shaft 12. The projection 32 is shaped so as to facilitate penetration of the shaft 12 into the ground. The projection 32 also prevents sand or other earthen material from entering the hollow shaft 12 through the first longitudinal end 18. Alternatively, shaft 12 may include a strip of aluminum, steel or plastic without projection 32 arranged so as to block the opening into the shaft at the first longitudinal end 18.

As shown in FIG. 1, the anchoring device is adapted to be readily inserted in the sand or loose dirt before receiving the umbrella pole or other device to be anchored. This is accomplished simply by grasping the handles 26 and 28 in each hand and initially driving the spiral-shaped member 16 into the ground. Then, the device can be rotated in the direction illustrated by arrow A in FIG. 1 to drive the shaft into the sand or ground. Continued rotation of the anchoring device using the handles 26 and 28 causes progressively deeper penetration of the spiral-shape member 16 into the ground. Eventually, the shaft is driven sufficiently into the ground that the auger 14 begins to penetrate the ground. When this occurs, continued rotation of the device 10 results in the auger 14 being filled with sand or earthen material. This, in turn, results in a significant anchoring effect. According to a preferred use of the invention, rotation of the anchoring device 10 terminates immediately or soon after the entire auger 14 is buried.

Once in place, the anchoring device 10 is adapted to receive the pole 34 of a beach umbrella 36 as shown in FIG. 2. Once the pole 34 has been adequately received, the thumb screw 24 is tightened so as to urge the pole 34 tightly against the inner surface of the shaft 12. The anchoring device 10 thus becomes securely attached to the pole 34. While not preferred, it is also possible to position the anchoring device in the sand or dirt after assembly with the pole 34 in the same manner as described above.

Should the diameter of the pole 34 be significantly smaller than the internal diameter of the shaft 12, a sleeve can be inserted into the shaft 12 to occupy the space that would otherwise separate the pole 34 from the inside of the shaft 12. This arrangement would thus provide added stability when the diameters of the pole 34 and shaft 12 differ significantly. The sleeve is preferably made of plastic and has a longitudinal length of 0.75 to 2.0 inches.

It will be appreciated that the spiral-shaped member 16 provides an anchoring effect at the distal end of the anchoring device 10, while the auger 14 provides anchoring at an intermediate location along the longitudinal length of the shaft 12. This combination of anchoring at a distal end of the shaft 12 and at an intermediate location, advantageously provides a significantly stable arrangement capable of withstanding lateral forces, such as those encountered by a beach umbrella in windy conditions.

After use, the anchoring device can be removed from the ground by simply rotating the device in a direction opposite to arrow A in FIG. 1, with or without prior removal of pole 34 and umbrella 36. Such removal can be expedited by also exerting an upward force on the anchoring device 10 or on the umbrella post if still attached thereto.

The preferred dimensions of the anchoring device will now be described. It is understood, however, that various other dimensions can be used depending on the intended use of the device 10, and that such other dimensions are well within the scope and spirit of the present invention.

For reasons of stability in windy conditions, the shaft 12 is preferably about 11 inches long, and has an outer diameter of approximately 1.5 inches. The length of the shaft 12, however, will depend on the length of the object to be anchored. In particular, it has been found that maintaining a ratio of at least 4 to 1 between the length of the object to be anchored and the length of the anchoring device 10 provides an adequate anchoring effect. The length of the shaft 12 therefore should be made to provide an overall length of the anchoring device 10 that is at least ¼ the length of the object to be anchored.

The spiral-shaped member 16 extends about 3 inches beyond the first end 18 of the shaft 12, and has an outer diameter of about 2 inches. It is understood that the spiral-shaped member 16 need not have the rectangular cross section illustrated in the drawings, and that alternatively, the spiral-shaped member 16 can have a circular cross section.

The thumb screw 24 is preferably positioned about 1 inch from the second end 20 of the shaft 12, and preferably includes a diameter of approximately ¼ inch, approximately 20 threads per inch, and a length of about 1 inch.

Figure 3:
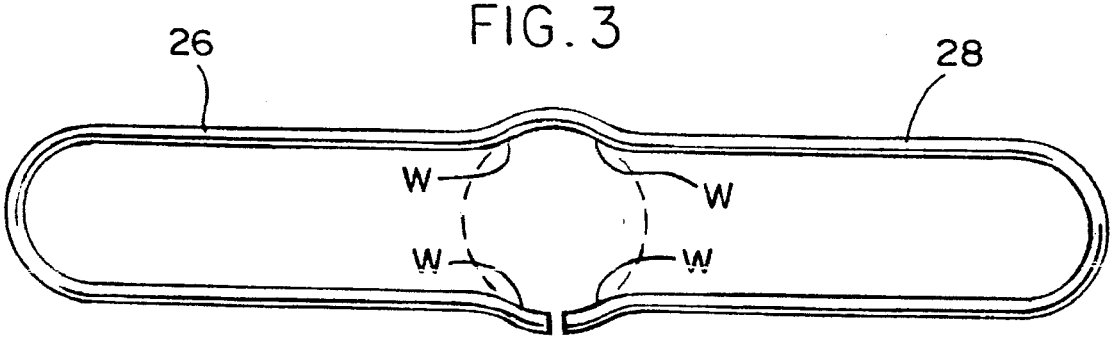
FIG. 3 a top view of a handle structure for the anchoring device according to the present invention.

The pair of handles 26,28, together, preferably span a length of approximately 8 inches, and are preferably made of steel. With reference to FIG. 3, the handles 26,28 can be manufactured by deforming the elongated ring of steel only slightly so as to retain the ring's original shape to some extent. In the embodiment of FIG. 3, the handles 26,28 can be welded to the shaft 12 by spot welding the four points W of the handles 26,28 where the handles 26,28 begin to diverge away from the shaft 12. The handles 26,28 of FIG. 3 are preferably made using an approximately 0.207 inch diameter, round steel rod.

The auger 14 preferably has an inner diameter of about 1.5 inches, and an outer diameter of about 5 inches. The inner diameter matches the outer diameter of the shaft 12 so that it can be readily welded thereto. The upwardly curved edge 30 of the auger 14 extends radially out about 1.75 inches from the shaft 12. In addition, the edge 30 curves up to a height of about 0.5 to 0.75 inches from the bottom 38 of the auger 14. The auger 14 is preferably welded to the shaft 12 at a position about 2 inches below the thumb screw 24.

If the shaft 12 includes a strip of aluminum, steel or plastic arranged so as to block the opening into the shaft 12 at the first longitudinal thickness end 18, this strip of preferably has a width of about 0.5 to 0.75 inches. The projection 32 is preferably made of plastic and extends about 0.75 inches from the first longitudinal end 18 of the shaft 12.

Alternatively, with reference to FIG. 4, the projection 32 comprises a plastic member 32' which can be secured to the first longitudinal end 18 of the shaft 12. The plastic member 32' comprises a sleeve-shaped base 32A dimensioned so as to be received in the longitudinal end 18 of the shaft 12, and a plurality of radially inwardly projecting cutting fingers 32B. The radially inwardly projecting cutting fingers 32B extend longitudinally forward of the sleeve-shaped base 32A and terminate about 0.9 inches forward of the sleeve-shaped base 32A. A tip 32C and hole in the tip 32C are defined by the termination of the fingers 32B. Preferably, there are two or four cutting fingers 32B. Preferably, each of the fingers 32B taper from a width of about 0.15 inch at the base 32A to a width of about 0.05 inch at the tip 32C. In addition, the sleeve-shaped base 32A preferably has a longitudinal length of about 0.9 inch. The cutting fingers 32B facilitate penetration of the shaft 12 into the ground by cutting away earthen material or sand during penetration.

Figure 5:
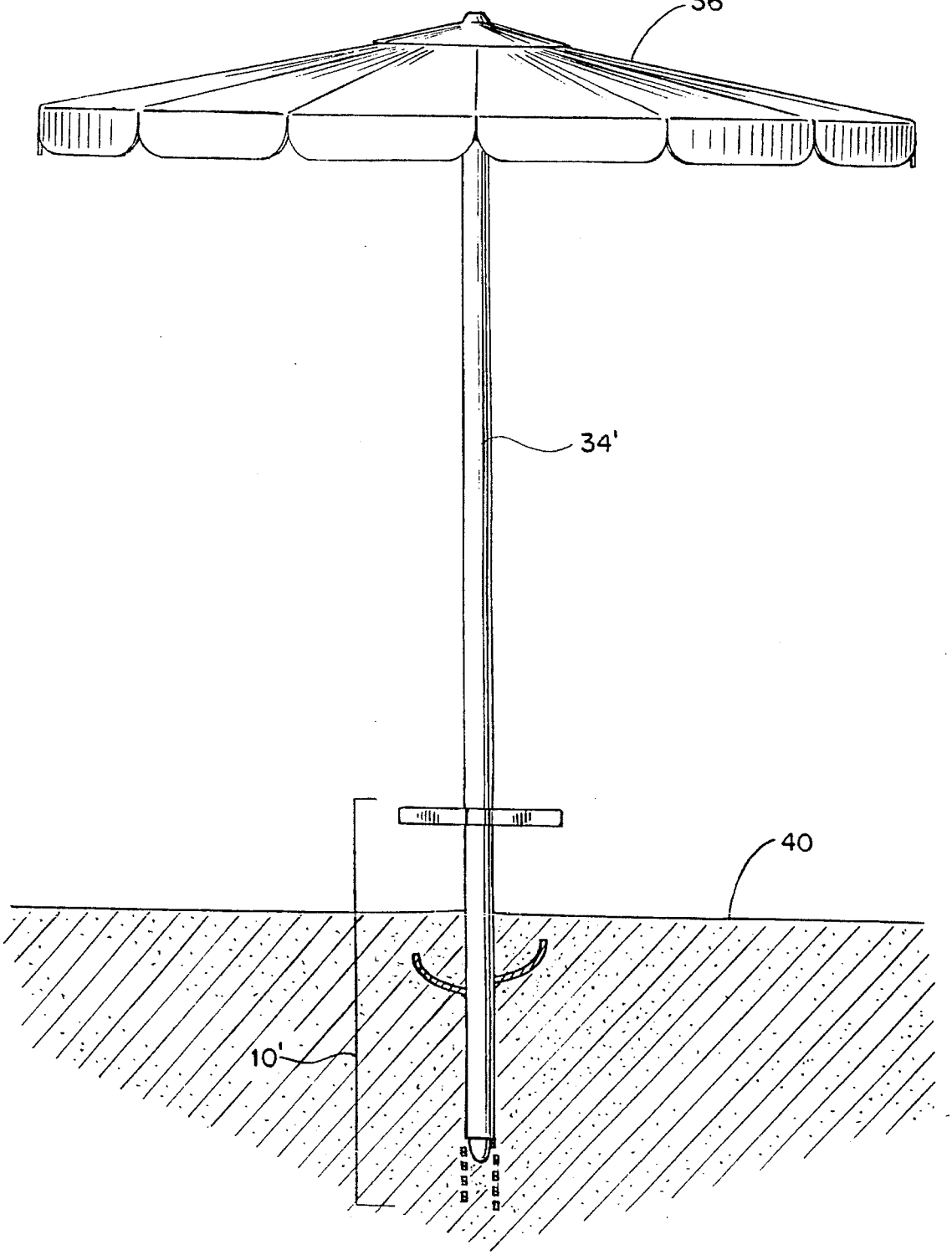
FIG. 5 is a perspective view of another embodiment according to the present invention in which a beach umbrella is integral with the anchoring device and the device is shown positioned in the ground.

With reference to FIG. 5, an alternative embodiment of the present invention comprises a beach umbrella 36' and a post 34' with an integrally formed anchoring device 10' at the bottom of the post 34'. FIG. 3 illustrates the anchoring device 10' after having been driven into the ground 40. It will be understood that the anchoring device 10' may be constructed, and will operate, in much the same way as the anchoring device 10 of FIGS. 1 and 2.

Although the anchoring device 10 in the above description is made of steel, it is understood that other materials such as plastic and aluminum can be used to make the anchoring device 10 or 10'.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. An anchoring device for a beach umbrella comprising:

a shaft having a first longitudinal end, a second longitudinal end, and a given length, said second longitudinal end being adapted to accommodate a beach umbrella post;

a spiral-shaped member connected to, and extending beyond, said first longitudinal end of the shaft, and outwardly therefrom a first distance, to facilitate entry of said anchoring device into the ground when said anchoring device is rotated in a first rotational direction about a longitudinal axis thereof;

an auger disposed circumferentially around said shaft and having a curved bottom edge to facilitate entry of said auger into the ground upon continuing rotation of said anchoring device in said first rotational direction, said auger also having an upwardly curved radial outward edge to form a scooped-shaped configuration to firmly hold earthen material in a manner which restricts withdrawal of said auger from the ground after said auger has been inserted into the ground;

at least one handle coupled with said first longitudinal end of said shaft to rotate said anchoring device about said longitudinal axis; and means for fastening said shaft to said beach umbrella post; and wherein said auger extends outwardly from said shaft a second distance greater than said first distance.

2. The anchoring device of claim 1, wherein said second longitudinal end of said shaft is hollow so as to at least partially receive said beach umbrella post.

3. The anchoring device of claim 1, and further comprising a projection at said first longitudinal end of the shaft to facilitate penetration of said shaft into the ground.

4. The anchoring device of claim 1 wherein said auger is disposed circumferentially around said shaft in substantially one complete turn.

5. The anchoring device of claim 1 wherein said length of said shaft is at least ¼ the length of said beach umbrella post to be anchored.

6. The anchoring device of claim 1 wherein said shaft is constructed of a hollow tubing of substantially 1.5 inch diameter, wherein said spiral-shaped member has an outer diameter of substantially 2 inches, and wherein said auger has an inner diameter of substantially 1.5 inches and an outer diameter of substantially 5 inches.

7. The anchoring device of claim 1 comprising a pair of handles radially projecting out from said shaft to rotate said shaft about said longitudinal axis.

8. A beach umbrella having a post and an anchoring device disposed at a bottom of said post, said anchoring device comprising:

a spiral-shaped member connected to, and extending beyond, the bottom of said post, and outwardly therefrom a first distance, to facilitate entry of said post and said auger into the ground when said post and anchoring device are rotated in a first rotational direction about a longitudinal axis of said post;

an auger disposed circumferentially around said post and having a curved bottom edge to facilitate entry of said post and said auger into the ground upon continuing rotation of said anchoring device in said first rotational direction, said auger also having an upwardly curved radial outward edge to form a scooped-shape configuration firmly hold earthen material in a manner which restricts withdrawal of said auger from the ground after said auger has been inserted into the ground; and at least one handle coupled with said post to rotate said anchoring device about said longitudinal axis; and wherein said auger extends outwardly from said post a second distance greater than said first distance.

9. The beach umbrella of claim 8, and further comprising a projection at the bottom of said post to facilitate penetration of said post into the ground.

10. The beach umbrella of claim 8 wherein said auger is disposed circumferentially around said post in substantially one complete turn.

11. The beach umbrella of claim 8 comprising a pair of handles radially projecting out from said post to rotate said post and said auger about said longitudinal axis.

* * * * *